United States Patent [19]

Gebert

[11] Patent Number: 4,964,637

[45] Date of Patent: Oct. 23, 1990

[54] ROVING SPINNING TOP PUZZLE

[76] Inventor: Paul Gebert, 4 Benham Cir., Cartersville, Ga. 30120

[21] Appl. No.: 371,924

[22] Filed: Jun. 27, 1989

[51] Int. Cl.[5] ..... A63B 67/14

[52] U.S. Cl. ..... 273/113; 273/109; 273/115

[58] Field of Search ..... 273/108, 109, 112, 115, 273/153 R

[56] References Cited

U.S. PATENT DOCUMENTS

| | | | |
|---|---|---|---|
| 1,099,615 | 6/1914 | Purse | 273/108 |
| 1,130,461 | 3/1915 | Zolper | 273/113 |
| 1,317,640 | 9/1919 | Nussbeck | 273/108 |
| 1,557,160 | 10/1925 | Haupenthal | 273/115 |
| 2,534,538 | 12/1950 | Thoresen | 273/115 |
| 2,857,163 | 10/1958 | Lykes | 273/108 |
| 2,971,288 | 2/1961 | Gill | 273/112 |
| 3,933,356 | 1/1976 | Torgow | 273/109 |

FOREIGN PATENT DOCUMENTS

| | | | |
|---|---|---|---|
| 20920 | 5/1906 | Sweden | 273/112 |

*Primary Examiner*—Randall L. Green
*Assistant Examiner*—Gary Jackson
*Attorney, Agent, or Firm*—Jonn L. James

[57] ABSTRACT

An apparatus for a game of skill has a base member with a gaming surface with a gaming pathway. An orbital pathway is formed on the base surface, and a handle is attached to the base. A top member has a vertical axis and a spindle that extends along the vertical axis. The spindle rides in the orbital pathway as the top member rotates its vertical axis attaining speed to travel the gaming pathway. A game played with the apparatus has as its object keeping the top member spinning long enough to negotiate the gaming pathway an attain points associated with the portion of the gaming pathway negotiated. The gaming pathway may contain obstacles that make the pathway more difficult to travel with point values assigned accordingly.

4 Claims, 2 Drawing Sheets

ROVING SPINNING TOP PUZZLE

CROSS REFERENCE TO RELATED APPLICATIONS

This application is relates to application Ser. No. 371,922 filed Jun. 27, 1989, now U.S. Pat. No. 4,961,577, ORBITAL SPINNER, filed herewith, and application Ser. No. 371,923, filed Jun. 27, 1989 now U.S. Pat. No. 4,928,968, SPINNING TOP AND PROJECTILE GAME, filed herewith, by the present inventor.

TECHNICAL FIELD

This invention relates generally to amusement devices, and more particularly relates to a puzzle game utilizing a spinning top apparatus and method for playing a game that challenges coordination and reflex action of the player.

BACKGROUND OF THE INVENTION

Amusement devices and games are enjoyed by people all over the world. Virtually every person uses some sort of amusement device or plays with a toy or game. Unfortunately, many games require two or more persons to play and may take hours to complete. It is desirable to have a game that can be played quickly and can be played by a single person as well as by a group of persons.

A problem with some games is that the games include an element of luck. Some games, for example, introduce an element of chance with dice or cards so that the outcome is skewed by the roll of the dice or the lay of the cards. Such an element of chance diminishes the skill level required for the games. It is highly desirable to have a game that does not include an element of chance and relies purely on the skill and reflexes of the player.

The number of games available for handicapped persons who are confined to a wheelchair is limited. Some games cannot be enjoyed by persons who have limited use of their legs, are heating impaired, or mentally impaired. Also, games requiring the use of the legs are difficult, if not impossible, to play in confined areas as such as a bus, train or airplane. It is therefore desirable to have a game that can be enjoyed by adults, children and handicapped persons, and can be played when traveling by automobile, bus, train or airplane.

There are many cafes, bars and lunges that are frequented by thousands of persons each day to eat, listen to music, watch wide screen television, rendezvous, and socialize. Bars, cafes and lounges are often convenient waiting places for travelers between flights and for business people between meetings. It will be appreciated that it would be highly desirable to have a game that could be played while people are waiting at a bar or in a cafe that does not tax the mental capacity of the player so that the games does not interfere with other mental activities.

SUMMARY OF THE INVENTION

The present invention is directed to overcoming one or more of the problems set forth above. Briefly summarized, according to one aspect of the invention, a game of skill has a base member with a gaming surface. An orbital pathway is positioned on the base, and a handle is attached to the base. A top member has a vertical axis and a spindle extending along the vertical axis that rides in the orbital pathway as the top member rotates about the vertical axis of the top member and traverse the gaming surface.

According to another aspect of the invention, a method of play including holding a base member having a handle and an orbital pathway in one hand, spinning a top member on the orbital pathway, imparting reciprocating motion to the base member causing the top member to ride along the orbital pathway increasing rotational speed as it travels along the pathway, and manipulating the handle and traversing the gaming surface with said top member.

The present invention uses equipment that is simple in both construction and operation, and is easily transported in a pocket or purse so that the game can be played at any time and anywhere. Because the equipment is simple, the game can be enjoyed by handicapped persons and can be played when traveling by automobile, bus, train or airplane.

The game can be played quickly and can be played by a single person as well as by a group of persons. It is therefore a suitable game for playing while waiting in a cafe, bar, restaurant or lounge. It is also ideally suited for public waiting areas in airports and the like.

The game relies purely on the skill of the player and does not include an element of chance. It is therefore a game that can be used in tournaments and other events that require or highlight player skill.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
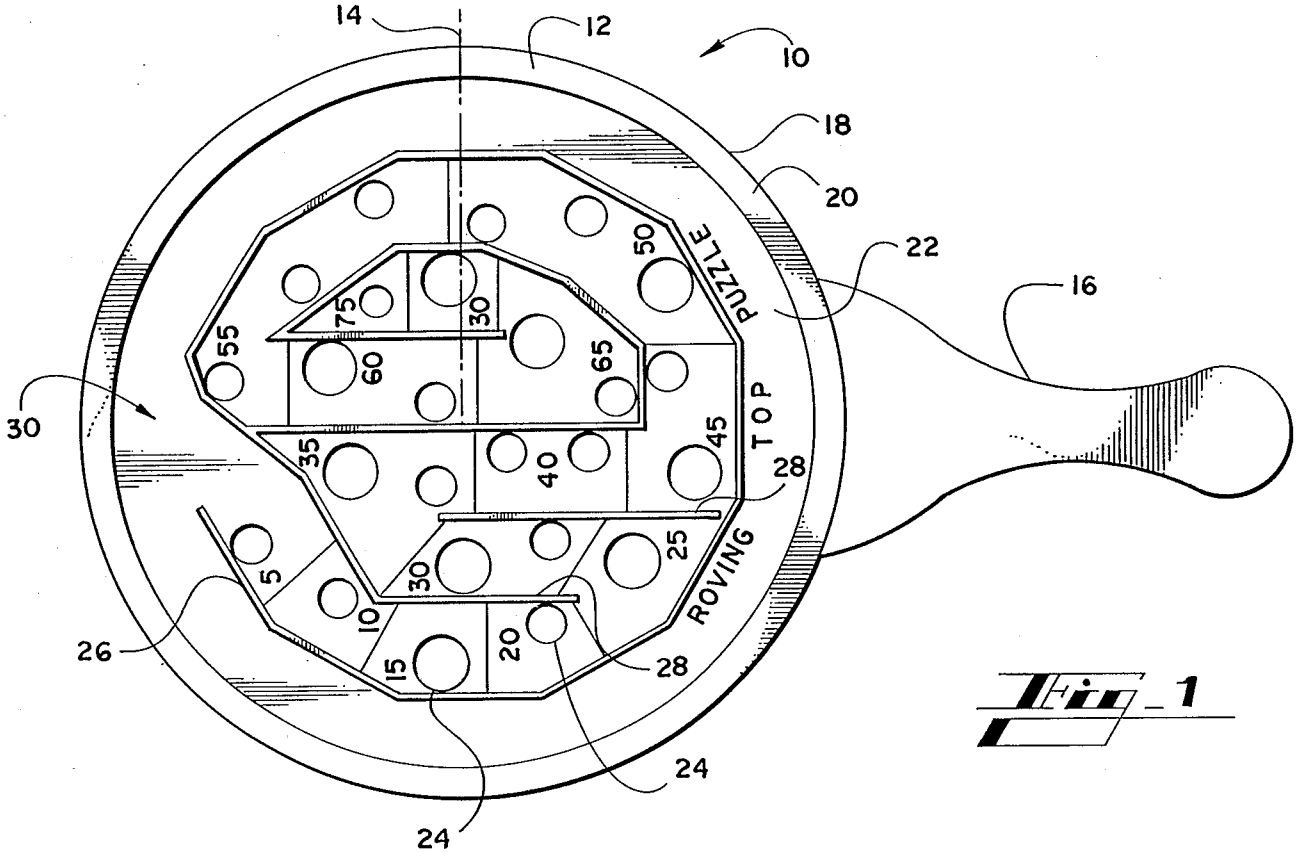
FIG. 1 is a top view of a preferred embodiment of a base member of a roving spinning top puzzle apparatus for playing a game of skill and coordination according to the present invention.
Figure 2:
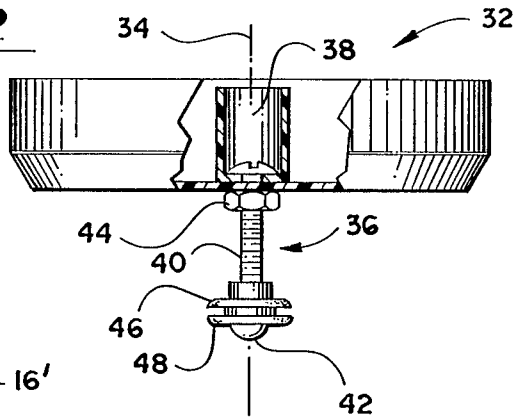
FIG. 2 is a diagrammatic side view of a top member of a roving spinning top puzzle apparatus with sections cut away to reveal interior members.
Figure 3:
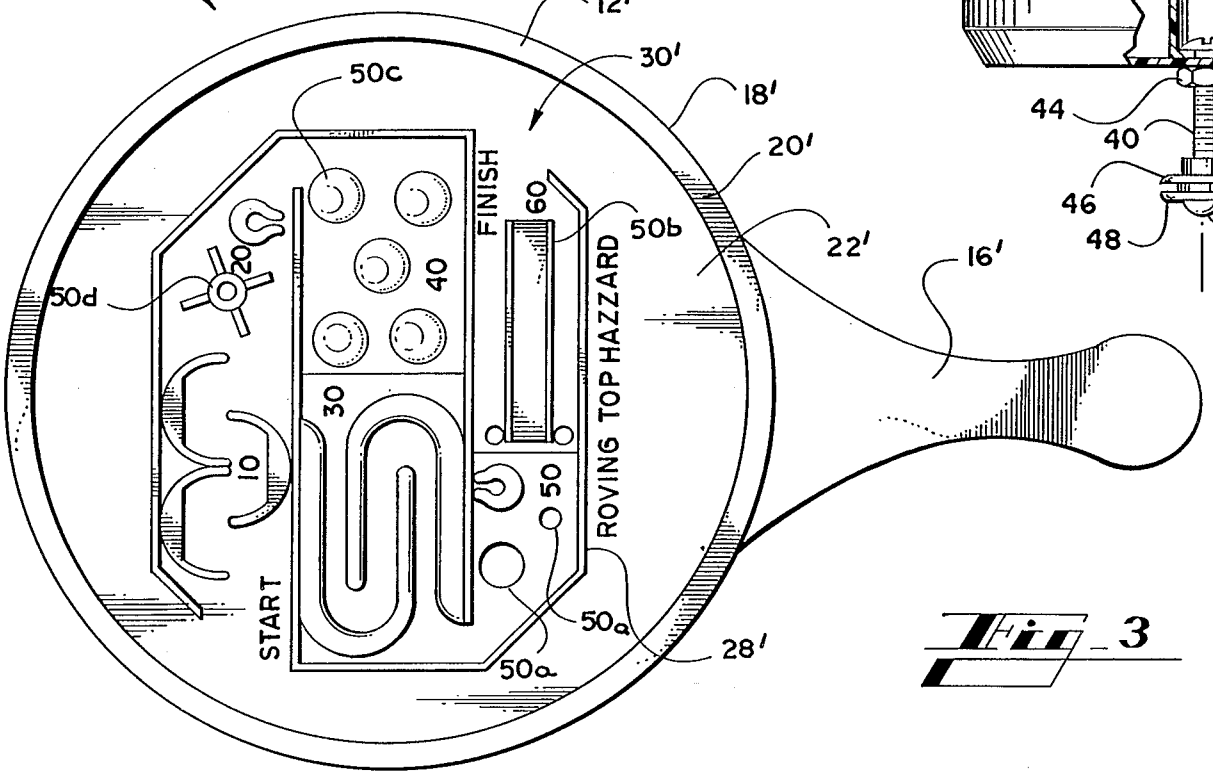
FIG. 3 is a diagrammatic top view similar to FIG. 1 but illustrating another embodiment.

Referring now to the drawings, in which like numerals indicate like elements throughout the several figures, FIGS. 1–3 illustrate an apparatus for playing a game of skill and coordination. In FIG. 1, the apparatus includes a base member 10 that has a surface 12 and a vertical axis 14 that extends perpendicular to the surface 12 of the base member 10. A handle 16 is attached to the base member 10. The base member 10 has an upturned edge portion 18 about its periphery defining an orbital pathway 20 on the base member 10.

A gaming surface 22 is adjacent the orbital pathway 20. A plurality of openings 24 in the base member 10 extend through the gaming surface 22. An elongated divider 26 is on the gaming surface 22 and has a plurality of laterally projecting ribs 28. The divider 26 and ribs 28 define a gaming pathway 30 about the openings 24 so that the gaming pathway 30 has places where there is a hole and a reduced width of surface area. The elongated divider 26 preferably has a vertical height less than the height of the upturned edge portion 18 of the base member 10. The divider 26 is laid out on the gaming surface 22 in a circuitous route defining a single gaming pathway 30 adjacent the orbital pathway 20. The gaming pathway 30 begins at a first location adjacent the orbital pathway 20 and extends across the gaming surface 22. The gaming pathway 30 may terminate on the gaming surface 22 or may exit at a second location adjacent the orbital pathway 20.

Referring to FIG. 2, the apparatus has a top member 32 with a vertically extending axis 34. A spindle 36 extends along the vertical axis 34 and has a size and configuration sufficient for riding in the orbital pathway of the base member 10 as the top member 32 rotates about its vertical axis 34. When spun, the top member 32 travels along the orbital pathway making an orbit about the vertical axis 14 of the base member 10 each time the top member 32 passes the handle 16 that is attached to the base member 10. The speed at which the top member 32 rotates increases in response to circular motion of the base member 10 about its vertical axis 14. The speed at which the top member 32 rotates also increases in response to reciprocating movement of the handle 16 of the base member 10.

Still referring to FIG. 2, the spindle 36 includes a hollow cylindrical member 38 that is pen on one end and has an opening in the other end through which a shaft 40 of the spindle assembly 36 extends. The shaft 40 is preferably a threaded member which extends through the opening in the hollow member 38, an opening in the top member 32 and terminates in a rounded end portion 42. A nut 44 threaded on the shaft 40 secures the cylindrical member 38 and top member 32 together so that the cylindrical member 38 and top member 32 move together as a unit. A stop nut 46 is threaded on the shaft 40 a preselected distance.

A grommet 48 is placed on the shaft 40 between the stop nut 46 and the rounded end portion 42, leaving the rounded end portion 42 exposed. The height of the grommet 40 on the shaft 40 is sufficient to cause the grommet 48 to make abutting contact with the upturned edge portion 18 of the base member 10. The height of the grommet 48 is sufficient to clear the dividing member 26 and the ribs 28.

Alternatively, the end of the spindle shaft 40 may be tapered or pointed instead of rounded. Preferably, the shaft 40 is constructed of a low friction material, such as nylon for example, although other synthetic materials and metals can be used. Nylon, however, introduces less friction and is believed to be the better element for construction of the spindle assembly 36. The other components may be constructed either of metal or plastic. Plastic materials have the advantage of being easily shaped and machined and can be molded in various decorative shapes and patterns.

Referring to FIG. 1–2, when the top member 32 is spun in the orbital pathway 20, the top member 32 can enter the maze pathway 30. The plurality of openings 24 are each assigned a numerical point value with the values increasing along the pathway 30. When playing, the point score is the numerical point value assigned to the opening 24 where the top member 32 comes to rest. The openings 24 have a size sufficient for capturing the end 42 of the spindle 36, or more preferably, the grommet 48.

Referring to FIG. 3, a gaming surface 22' has a gaming pathway 30' with a number of obstacles 50 along the pathway 30'. The obstacles 50 include holes **50*a*, hills 59*b*, , hurdles 50*c*, and turnstiles 50*d* that are ribs or raised projections in the pathway 30' to be negotiated by the top member 32**.

It will now be appreciated that there has been disclosed an apparatus and method for playing a game that challenges the coordination and reflexes of the player. A single person can play the game with the apparatus according to the method of the present invention. The game can be played quickly and can also be played by a group of persons and groups may compete against one another. Unlike some games that depend on the luck of the player, the present invention does not include an element of chance and relies purely on the skill and reflexes of the player. The equipment required to play is transportable so that the game can be played at any time and anywhere. The game can be enjoyed by adults, children and handicapped persons and can be played when traveling by automobile, bus, train or airplane. It can also be played while waiting at a bar or in a cafe without taxing the mental capacity of the player so that it does not interfere with other mental activities.

While operation of the present invention is believed to be apparent from the forgoing description, a few words will be added for emphasis. The apparatus includes a base member 10 and a top member 32 that rotates about its axis 34 and travels in a pathway formed on the base member 10. The base member 10 has a handle 16 to impart reciprocating motion to the base member 10 and also to rotate the base member 10 about its axis 14. A method of play comprises holding the base member 10 in one hand, spinning the top member 32 and placing the top member 32 in the orbital pathway 20. The object of the game is to have the top member 32 negotiate the gaming pathway 22 before the top member 32 ceases to spin. The faster the top member 32 rotates about its own axis 34, and the faster the top member 32 travels about axis 14 of the base member 10, the longer the top member 32 will spin. The speed of rotation about its axis and the rate of travel about the pathway is increased by placing the top member 32 in the orbital pathway and reciprocating the handle 16.

The game can be played by one person seeking to increase previous scores or to attain a certain number of points. The game can also be played by two or more persons competing against one another. A very proficient player may be able to negotiate the entire gaming surface before the top member stops spinning. When this happens, the player can start a second trip along the gaming pathway. For such a occurrence, the point values for the holes or obstacles along the pathway may be summed for total score, or a number of points may be awarded for completely negotiating the gaming pathway.

While the invention has been described with particular reference to the preferred embodiments, it will be understood by those skilled in the art that various changes may be made and equivalents may be substituted for elements of the preferred embodiment without departing from invention. For example, the top member may be decorated to add visual impact, or the gaming surface may have a pathway that is itself narrow or otherwise difficult to negotiate. The pathway may also have a pattern or ribs or projections to inhibit the movement of the top member to reduce the time that the top member spins. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

I claim:

1. An apparatus, comprising:

a base member having a gaming surface;

an elongated divider on said gaming surface;

an orbital pathway on said base adjacent said gaming surface;

a plurality of lateral ribs extending from said divider, said divider and said lateral ribs defining a single pathway between first and second locations of said orbital pathway;

a handle attached to said base;

a rotatable top member; and a spindle attached to said top member and extending perpendicular thereto and being of a size and configuration sufficient for riding in said orbital pathway and traversing said gaming surface as said top member rotates, the speed at which said top member rotates increasing in response to reciprocating movement of said handle.

2. An apparatus, as set forth in claim 1, wherein said gaming surface of said base member includes a maze pathway beginning at a first location adjacent said orbital pathway and ending at a second location adjacent said orbital pathway.

3. An apparatus, as set forth in claim 1, wherein said divider and lateral ribs defining a single pathway between first and second locations of said orbital pathway.

4. An apparatus, as set forth in claim 3, including openings along said single pathway.

* * * * *